US011304546B1

(12) United States Patent
Boos

(10) Patent No.: US 11,304,546 B1
(45) Date of Patent: Apr. 19, 2022

(54) MODULAR CABINET THAT DIVIDES AND SUBDIVIDES PRODUCT ACCORDING TO ITS DIMENSIONS

(71) Applicant: Joshua B. Boos, Milton, NY (US)

(72) Inventor: Joshua B. Boos, Milton, NY (US)

( * ) Notice: Subject to any disclaimer, the term of this patent is extended or adjusted under 35 U.S.C. 154(b) by 127 days.

(21) Appl. No.: 16/265,302

(22) Filed: Feb. 1, 2019

Related U.S. Application Data

(60) Provisional application No. 62/626,311, filed on Feb. 5, 2018.

(51) Int. Cl.

| | |
|---|---|
| ***A47F 5/10*** | (2006.01) |
| ***A47F 7/28*** | (2006.01) |
| ***A47F 5/00*** | (2006.01) |
| ***A47B 57/10*** | (2006.01) |
| ***A47B 57/04*** | (2006.01) |
| ***A47B 47/00*** | (2006.01) |

(52) U.S. Cl.
CPC ..... *A47F 5/101* (2013.01); *A47B 47/0075* (2013.01); *A47B 57/04* (2013.01); *A47B 57/10* (2013.01); *A47F 5/0018* (2013.01); *A47F 5/0056* (2013.01); *A47F 7/28* (2013.01)

(58) Field of Classification Search
CPC ..... A47F 5/101; A47F 5/0018; A47F 5/0056; A47F 7/28; A47B 47/0075; A47B 57/04; A47B 57/10
USPC ..... 312/265.5
See application file for complete search history.

(56) References Cited

U.S. PATENT DOCUMENTS

| | | | | | |
|---|---|---|---|---|---|
| 2,933,195 | A * | 4/1960 | Radek | A47B 57/58 | 211/153 |
| 3,570,679 | A * | 3/1971 | Edson | A47F 7/163 | 211/47 |
| 3,846,944 | A * | 11/1974 | Lambert | A47B 47/021 | 52/236.3 |
| 4,193,650 | A * | 3/1980 | Gray | A47B 45/00 | 108/61 |
| 5,364,178 | A * | 11/1994 | Hofman | A47B 47/02 | 312/263 |
| 5,716,116 | A * | 2/1998 | Carlson | A47B 96/1483 | 312/280 |
| 5,890,606 | A * | 4/1999 | Kuipers | H01M 50/20 | 211/186 |
| 6,705,477 | B1 * | 3/2004 | Narkis | A47B 57/588 | 211/153 |
| 7,743,932 | B2 * | 6/2010 | Lynch | A47F 5/0056 | 211/184 |
| 8,813,980 | B1 * | 8/2014 | Billman | A47B 96/021 | 211/187 |
| 10,159,341 | B1 * | 12/2018 | Thompson | A47F 5/0056 | |

(Continued)

*Primary Examiner* — Daniel J Troy
*Assistant Examiner* — Timothy M Ayres
(74) *Attorney, Agent, or Firm* — Daniel J. Polglaze; Westman, Champlin & Koehler, P.A.

(57) ABSTRACT

A cabinet includes a frame, having a top pan and a bottom pan, and a pair of sides coupled to the top pan and the bottom pan to form the frame. A shelf is adjustably mounted in the frame in one of a substantially level or a slanted orientation. The shelf has a plurality of shelf openings therethrough on a shelf face, the shelf openings configured to provide multiple lateral subsection configurations. A plurality of divider rods sized to be accommodated in the pan openings and shelf openings, the divider rods configured to divide the frame into the multiple lateral subsections.

20 Claims, 9 Drawing Sheets

(56) References Cited

U.S. PATENT DOCUMENTS

| | | | | |
|---|---|---|---|---|
| 2004/0256341 | A1* | 12/2004 | Donnell | A47F 5/0056 211/187 |
| 2006/0175945 | A1* | 8/2006 | Deguchi | A47B 88/417 312/257.1 |
| 2007/0252496 | A1* | 11/2007 | Remondino | A47F 5/0093 312/351 |
| 2019/0357699 | A1* | 11/2019 | Sudds | A47F 5/0018 |
| 2021/0267373 | A1* | 9/2021 | Steere | A47B 88/60 |

* cited by examiner

MODULAR CABINET THAT DIVIDES AND SUBDIVIDES PRODUCT ACCORDING TO ITS DIMENSIONS

CROSS-REFERENCE TO RELATED APPLICATION

The present application is based on and claims the benefit of U.S. provisional patent application Ser. No. 62/626,311, filed Feb. 5, 2018, the content of which is hereby incorporated by reference in its entirety.

BACKGROUND

Hair salons utilize many different hair-color-lines, of which there are multiple shades within a hair-color-line. Further, the dimensions of hair-color boxes or bottles differ one from the next. This leads to multiples of the same product being opened, inventory not on hand, and time wasted searching for a desired product.

Other systems/devices dictate to a user what the system/device is able to hold within the predetermined/unadjustable subsections provided. The opened product is usually in an area where a user may not retrieve the unopened product easily.

SUMMARY

In one embodiment, a cabinet includes a frame, having a top pan and a bottom pan, and a pair of sides coupled to the top pan and the bottom pan to form the frame. A shelf is adjustably mounted in the frame in one of a substantially level or a slanted orientation. The shelf has a plurality of shelf openings therethrough on a shelf face, the shelf openings configured to provide multiple lateral subsection configurations. A plurality of divider rods sized to be accommodated in the pan openings and shelf openings, the divider rods configured to divide the frame into the multiple lateral subsections.

Other aspects of the cabinet which may be included alone or in combination include the following. An aspect wherein each side of the pair of sides comprises a side inner panel and a side outer fascia. An aspect wherein each side inner panel includes a plurality of slanted grooves and a plurality of level grooves, the plurality of slanted grooves and the plurality of level grooves mirroring each other on opposite sides. An aspect wherein the side inner panels comprise polyvinyl chloride laminated foam. An aspect wherein the slanted orientation is toward a front of the frame. An aspect further including a top fascia coupled to and covering a top of the top pan, the top fascia comprising a solid piece, and a bottom fascia coupled to and covering a bottom of the bottom pan, the bottom fascia comprising a solid piece. An aspect wherein the top fascia and the bottom fascia are metal. An aspect wherein the top fascia and the bottom fascia have key openings for wall mounting the cabinet. An aspect wherein the shelf has a lip extending laterally from a first side to an opposite second side, the lip extending substantially perpendicular to the shelf face. An aspect wherein the top pan and the bottom pan each have a matching plurality of pan openings therein, the pan openings matching the shelf openings. An aspect wherein the top pan and the bottom pan each have a matching plurality of pan openings therein, the pan openings matching positioning of the shelf openings, the plurality of pan openings, the pan openings elongated front to back of the top pan and the bottom pan compared to the plurality of shelf openings. An aspect further including a back panel coupled to a back of the frame. An aspect wherein the back panel comprises a plurality of back panel sections.

In another embodiment, a method of assembling a cabinet includes assembling a frame comprising a top pan and a bottom pan, and a pair of sides coupled to the top pan and the bottom pan. A shelf is mounted in grooves in each of the pair of sides the frame in one of a substantially level or downward slanted position, the shelf having a plurality of shelf openings therethrough on a shelf face, the shelf openings configured to provide multiple lateral subsection configurations. A number of divider rods are mounted into matching shelf openings and corresponding pan openings to divide the frame into the multiple lateral subsections.

Other aspects of the method which may be included alone or in combination include the following. An aspect wherein mounting a shelf comprises mounting in one set of a plurality of slanted grooves and a plurality of level grooves mirroring each other on opposite sides of the pair of sides. An aspect further including fastening a top fascia to a top of the top pan, the top fascia comprising a solid piece, and fastening a bottom fascia to a bottom of the bottom pan, the bottom fascia comprising a solid piece.

In another embodiment, a cabinet includes a frame having a top pan and a bottom pan, and a pair of sides coupled to the top pan and the bottom pan to form the frame. The top pan and the bottom pan having a plurality of pan openings therethrough, the pan openings configured to provide multiple lateral subsection configurations in the frame. A shelf is adjustably mounted in the frame adjustable to a substantially level or to a slanted orientation, the shelf having a plurality of shelf openings therethrough on a shelf face, the shelf openings matching the pan openings. The shelf has a lip extending laterally from a first side to an opposite second side, the lip extending substantially perpendicular to the shelf face. A plurality of divider rods are accommodated in a same opening of the pan openings and the shelf openings. The divider rods are configured to divide the frame into the multiple lateral subsections. A top fascia is coupled to and covering a top of the top pan, the top fascia comprising a solid piece. A bottom fascia is coupled to and covering a bottom of the bottom pan, the bottom fascia comprising a solid piece.

Other aspects of the cabinet which may be included alone or in combination include the following. An aspect further including a back panel coupled to a back of the frame. An aspect wherein the back panel comprises a plurality of back panel sections.

DETAILED DESCRIPTION

Figure 1:
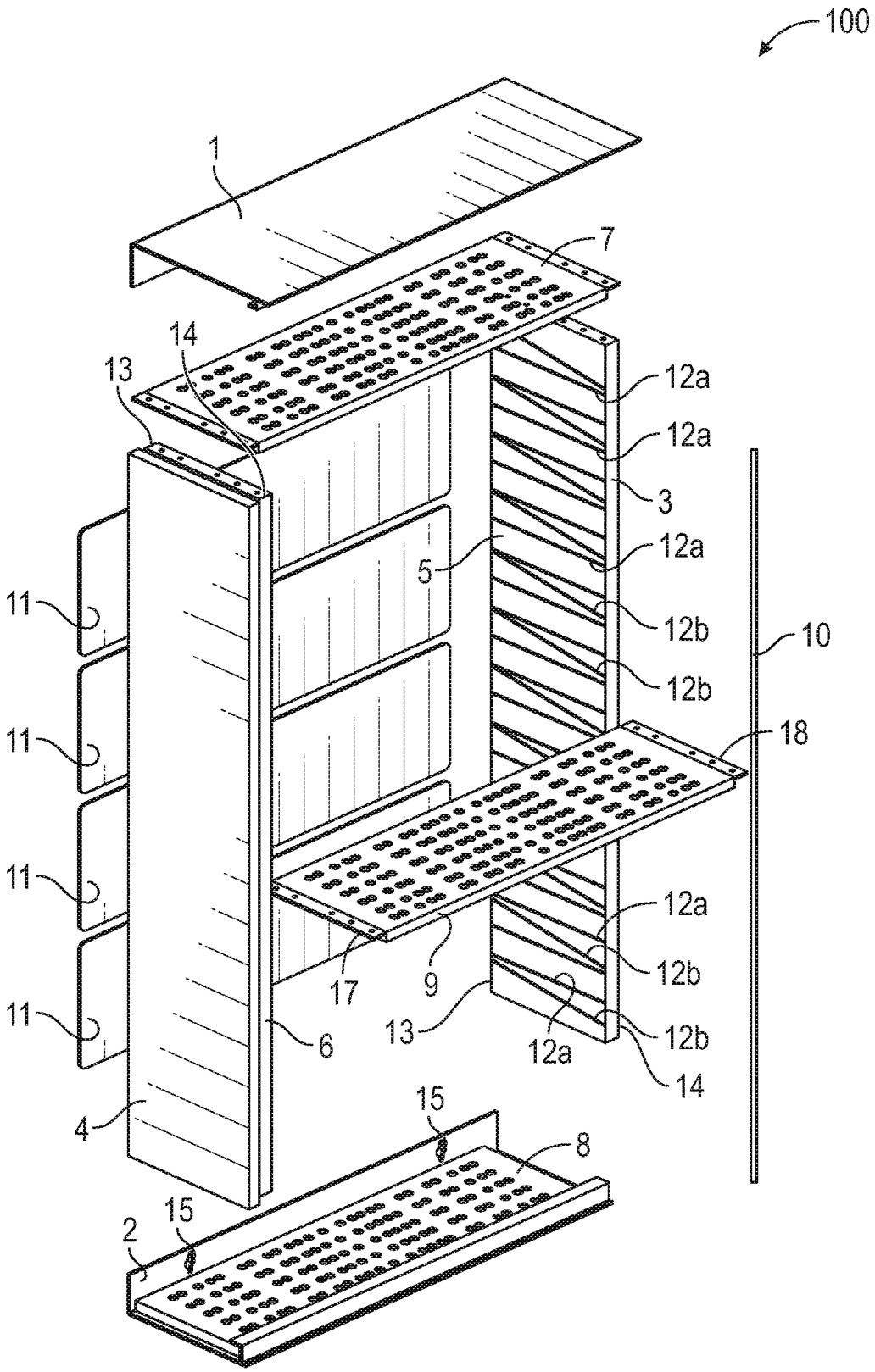
FIG. 1 is a partially exploded view of a cabinet according to an embodiment of the present disclosure.

The modular cabinet is able to divide and subdivide by the height and width of the product/s' dimensions. It creates an inventory management system specific to the end-users' needs, while enabling the end user to grab product quicker and put it back quicker without opening a product that is already opened within its subsection.

As stated above, hair salons utilize many different hair-color-lines, of which there are multiple shades within a hair-color-line. Further, the dimensions of hair-color boxes or bottles differ one from the next. This leads to multiples of the same product being opened, inventory not on hand and time wasted searching for a desired product. Embodiments of the present disclosure provide a modular and adjustable cabinet that may be assembled to provide easy access to open product, and unopened product when no opened product is available, or when opened product is finished.

The modular cabinet divides and subdivides product/s based on the dimensions of the products being stored; while creating an inventory management system specific to each product's size and shape.

The embodiments disclosed herein differ from what currently exists. There isn't a modular cabinet that divides and subdivides according to the product's dimensions, the end-users specific needs and/or shape of the product itself. The opened product, within its subsection, is placed on top of or in front of the unopened product (depending on the configuration) resulting in an inventory management system that an end user can clearly see and utilize, all in one cabinet.

Embodiments of the present disclosure provide improvements on what currently exists. There isn't a modular cabinet that divides and subdivides according to the product's dimensions, the end-users specific needs and/or shape of the product itself. In use, opened product, within its subsection, is placed on top of or in front of the unopened product (depending on the configuration), resulting in an inventory management system that allows a user to clearly manage, see, and utilize all products, all in one cabinet.

Problems with multiple opened tubes or boxes of product open at the same time, common with typical shelving systems, are reduced or eliminated with embodiments of the present disclosure. Also, the subsections of typical shelving systems are not specific to the products' dimensions, nor to an end-user's specific needs. This results in waste of space, time and product.

In contrast, embodiments of the present disclosure divide and subdivide by the height and width of a product/s' dimensions. It creates an inventory management system specific to the end-users' needs, while enabling faster product retrieval, replacement, and storage, all without opening a product that is already opened within its subsection.

Also, embodiments of the present disclosure allow for production of any type of cabinet needing organization and/or inventory management system, by dividing and subdividing the products within the unit.

Exemplary uses for embodiments of the present disclosure include but are not limited to a management system for artist's supplies; a management system for retail stores, and the like.

It should be noted that the same reference numerals are used in different figures for same or similar elements. It should also be understood that the terminology used herein is for the purpose of describing embodiments, and the terminology is not intended to be limiting. Unless indicated otherwise, ordinal numbers (e.g., first, second, third, etc.) are used to distinguish or identify different elements or steps in a group of elements or steps, and do not supply a serial or numerical limitation on the elements or steps of the embodiments thereof. For example, "first," "second," and "third" elements or steps need not necessarily appear in that order, and the embodiments thereof need not necessarily be limited to three elements or steps. It should also be understood that, unless indicated otherwise, any labels such as "left," "right," "front," "back," "top," "bottom," "forward," "reverse," "clockwise," "counter clockwise," "up," "down," or other similar terms such as "upper," "lower," "aft," "fore," "vertical," "horizontal," "proximal," "distal," "intermediate" and the like are used for convenience and are not intended to imply, for example, any particular fixed location, orientation, or direction. Instead, such labels are used to reflect, for example, relative location, orientation, or directions. It should also be understood that the singular forms of "a," "an," and "the" include plural references unless the context clearly dictates otherwise.

An exploded view of a cabinet 100 is shown in FIG. 1. Cabinet 100 comprises in one embodiment a top fascia 1, bottom fascia 2, side fascia 3 and 4 having inner panels 5 and 6, top and bottom inner pans 7 and 8, shelves 9, dividers 10, and back paneling 11. Side fascia 3 and 4, along with top and bottom fascia 1 and 2, serve as a frame for interconnecting cabinet 100. Side inner panels 5 and 6 fit into and are held in place to side fascia 3 and 4 and top and bottom inner pans 7 and 8.

Partial parts list:

1. Top-Fascia—Metal-cover with key-holes 15
2. Bottom-Fascia—Metal-cover with key-holes 15
3. Side-Fascia Left—Metal-cover
4. Side-Fascia-Right—Metal-cover
5. Side-Inner-Panel-Left—Routed Laminated PVC Foam
6. Side-Inner-Panel-Right—Routed Laminated PVC Foam
7. Top-Inner-Pan—Metal-substructure
8. Bottom-Inner-Pan—Metal-substructure

9. Shelf—Reversible metal panel with openings
10. Dividers—PVC rods
11. Back Panel—Flat metal panel
12*a*. Level shelf slots
12*b*. Slanted shelf slots
13. Back of cabinet 100
14. Front of cabinet 100
15. Key holes
18. Shelf lips
90. Shelf openings In one embodiment, Side-Inner-Panel-Left 5 is adhered into Side-Fascia-Left 3. Side-Inner-Panel-Right 6 is adhered into Side-Fascia-Right 4. Top-Inner-Pan 7 is fastened with a fastener (e.g., screws) to the combined Side-Fascia-Left 3 and Side-Inner-Panel-Left 5, as well as combined Side-Fascia-Right 4 and Side-Inner-Panel-Right 6. Bottom-Inner-Pan 8 is fastened with fasteners (e.g., screws) to the combined Side-Fascia-Left 3 and Side-Inner-Panel-Left 5 as well as to combined Side-Fascia-Right 4 and Side-Inner-Panel-Right 6. This creates a frame of cabinet 100.

Shelve/s 9 are mounted, for example by sliding, into the groove/s 12*a* and 12*b* that are in Side-Inner-Panel-Left 5 and Side-Inner-Panel-Right 6. Placement of a shelf 9 is determined by the end-user and/or product/s' height dimension. Different grooves 12*a* and 12*b* are provided in panels 5 and 6. For example, some grooves 12*a* are substantially level with respect to pans 7 and 8, and some grooves 12*b* are angled in a downward direction from a back 13 to a front 14 of the panels 5 and 6.

The Bottom-Fascia 2 and Back-Panel 11 are fastened with fasteners (e.g., screws) to the combined Side-Fascia-Left 3 and Side-Inner-Panel-Left 5 as well as to the combined Side-Fascia-Right 4 and Side-Inner-Panel-Right 6.

Cabinet 100 may stand on its Bottom-Fascia 2.

Assembly of a sections and subsections of cabinet 100 for product storage and retrieval is accomplished in one embodiment as follows. Dividers 10 are passed through the Top-Inner-Pan 7, Shelve/s 9 and Bottom-Inner-Pan 8. Placement of dividers 10 is determined by the end-user and/or products' width dimension. As discussed herein, dividers 10 may be used to create a uniform width set of sections across a shelf, or shelf openings 90 may be used to subdivide into different width sections.

Once the dividers 10 are placed into the shelf 9 and pan 7 and 8 openings 90, the) Top-Fascia 1 is fastened to the combined Side-Fascia-Left 3 and Side-Inner-Panel-Left 5, as well as to the combined Side-Fascia-Right 4 and Side-Inner-Panel-Right 6, with fasteners (e.g., screws, bolts, or the like).

Figure 2:
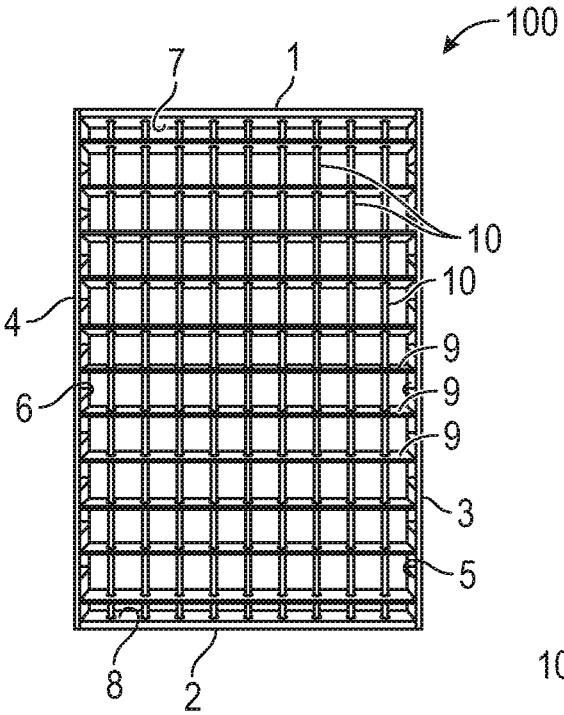
FIG. 2 is a front elevation view of an assembled cabinet according to an embodiment of the present disclosure.
Figure 3:
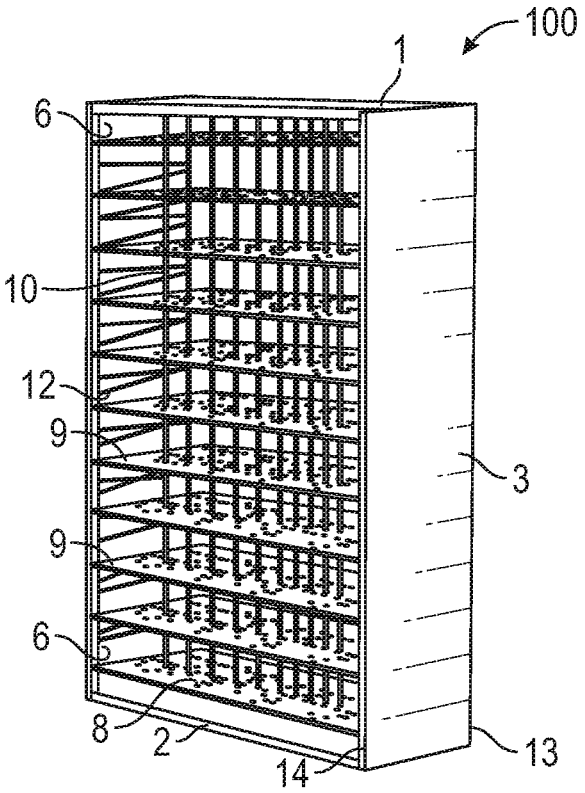
FIG. 3 is a perspective view of the cabinet of FIG. 2.
Figure 4:
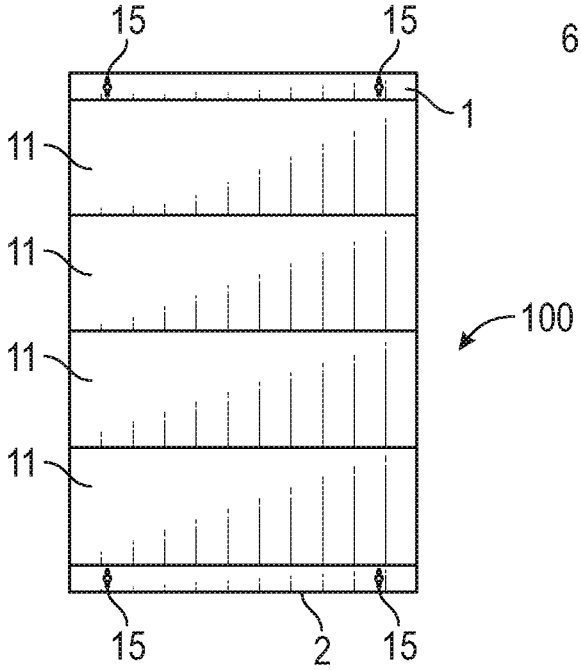
FIG. 4 is a back elevation view of the cabinet of FIG. 2.

FIGS. 2, 3, and 4 show assembled cabinet 100 in front elevation, perspective, and back elevation, respectively.

Figure 12:
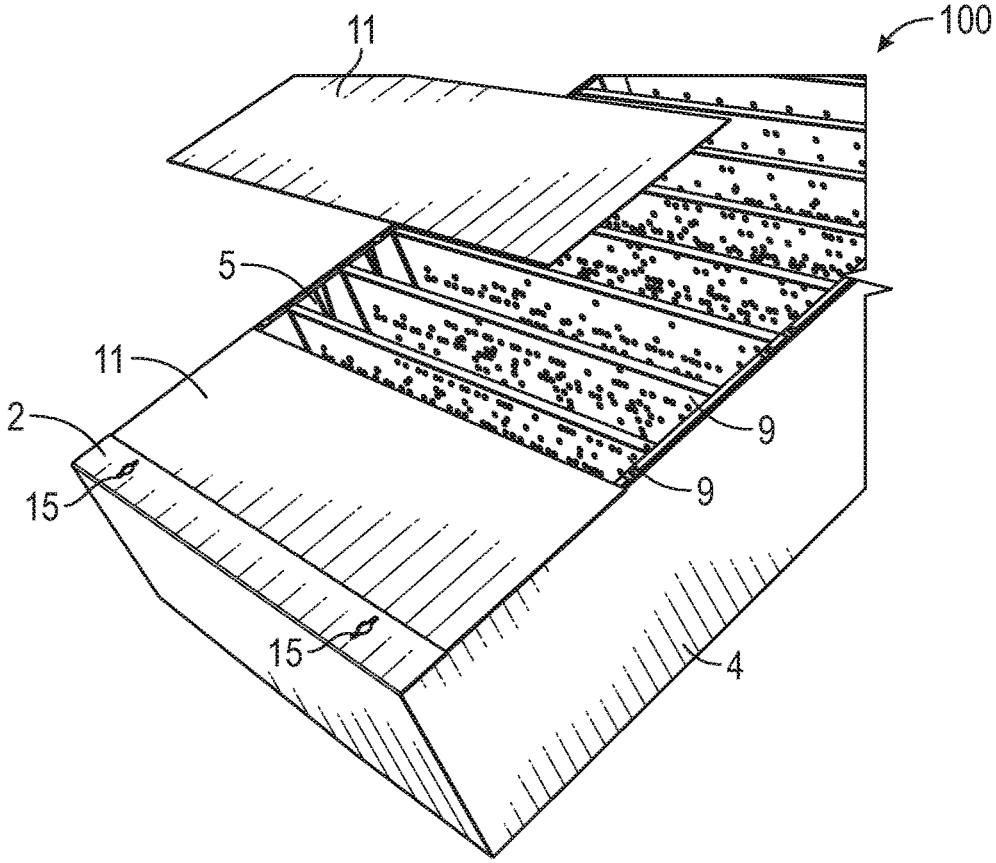
FIG. 12 is a partial rear perspective view of a cabinet and cabinet backing according to an embodiment of the present disclosure.

Back paneling 11 may optionally be provided for a portion or all of a vertical height of the cabinet 100, as shown in FIGS. 1, 4, and 12. While back paneling is shown as four panels 11, it should be understood that the back paneling may comprise more or fewer panels 11 without departing from the scope of the disclosure.

Key-holes 15 in Top-Fascia 1 and Bottom-Fascia 2 allow an end-user to mount cabinet 100 to a wall with appropriate hardware.

Figure 5:
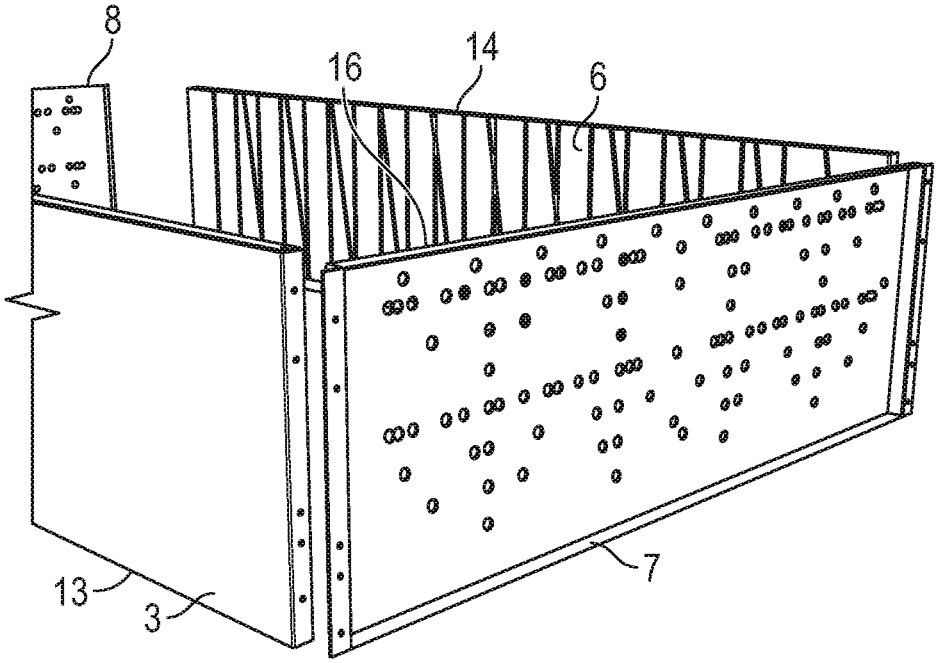
FIG. 5 is a partially exploded partial view of sides and top and bottom inner pans of an embodiment of the present disclosure.
Figure 6:
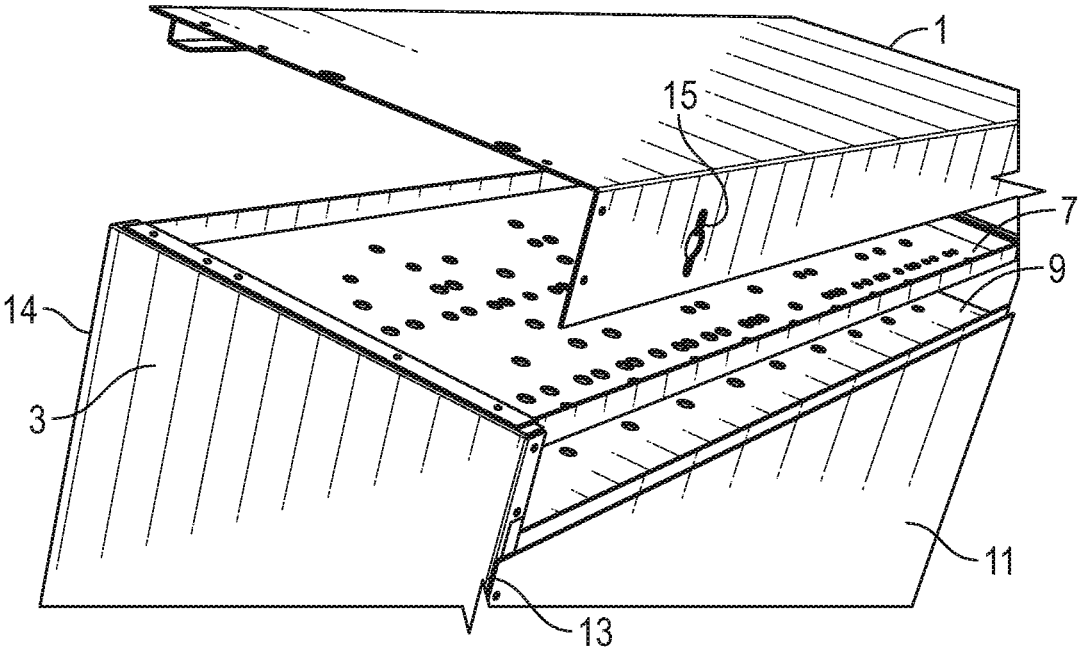
FIG. 6 is a partially exploded view of a bottom of a cabinet according to an embodiment of the present disclosure.
Figure 7:
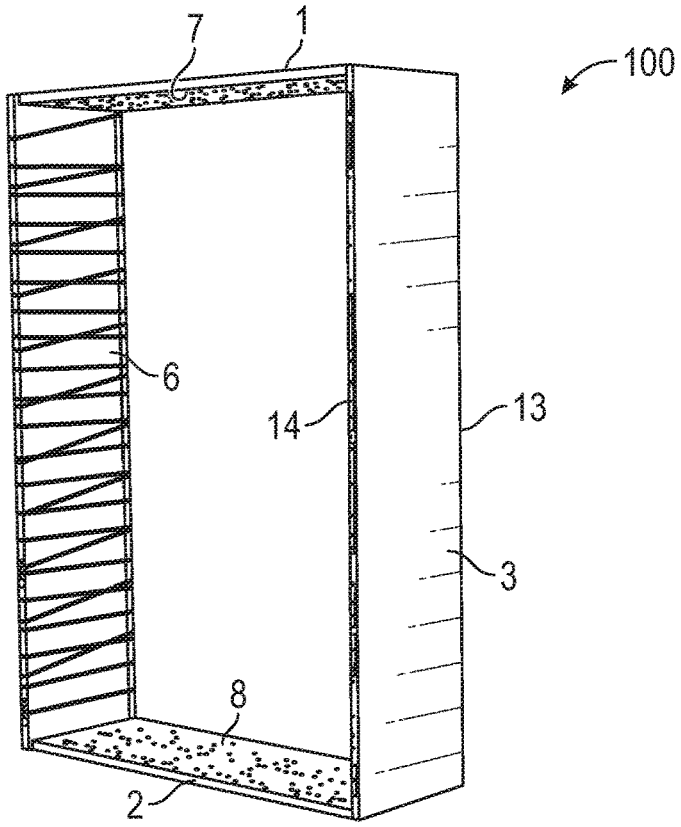
FIG. 7 is a perspective view of a frame of a cabinet according to an embodiment of the present disclosure.

Assembly of side panels 5, 6 and side fascia 3, 4 with top and bottom inner pans 7 and 8 is shown in FIG. 5. Installation of top fascia 1 is shown in FIG. 6. FIG. 7 is a perspective view of a frame of cabinet 100 comprising top and bottom fascia 1, 2, top and bottom pan 7, 8, and sides 3, 5 and 4, 6.

Figure 8:
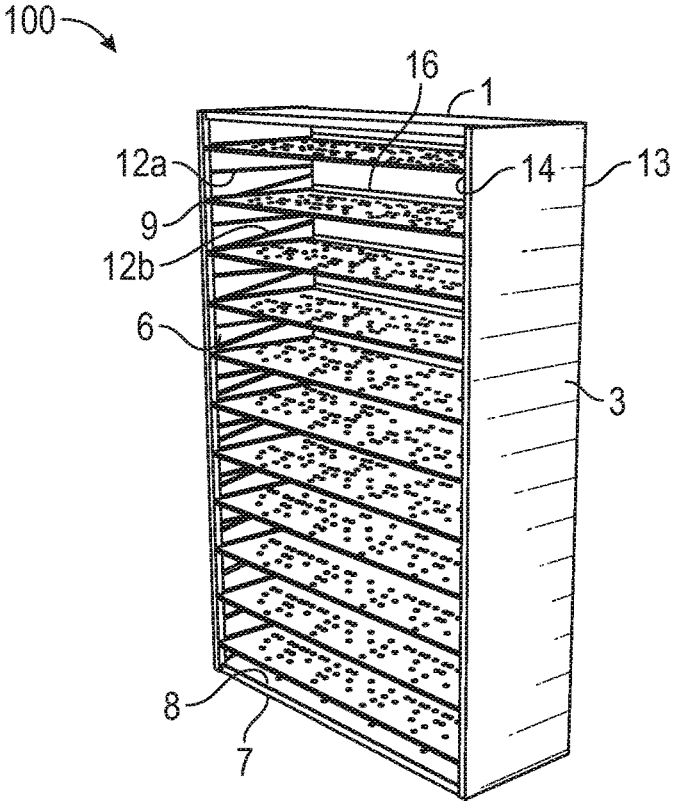
FIG. 8 is a view of a cabinet with level shelves according to an embodiment of the present disclosure.
Figure 9:
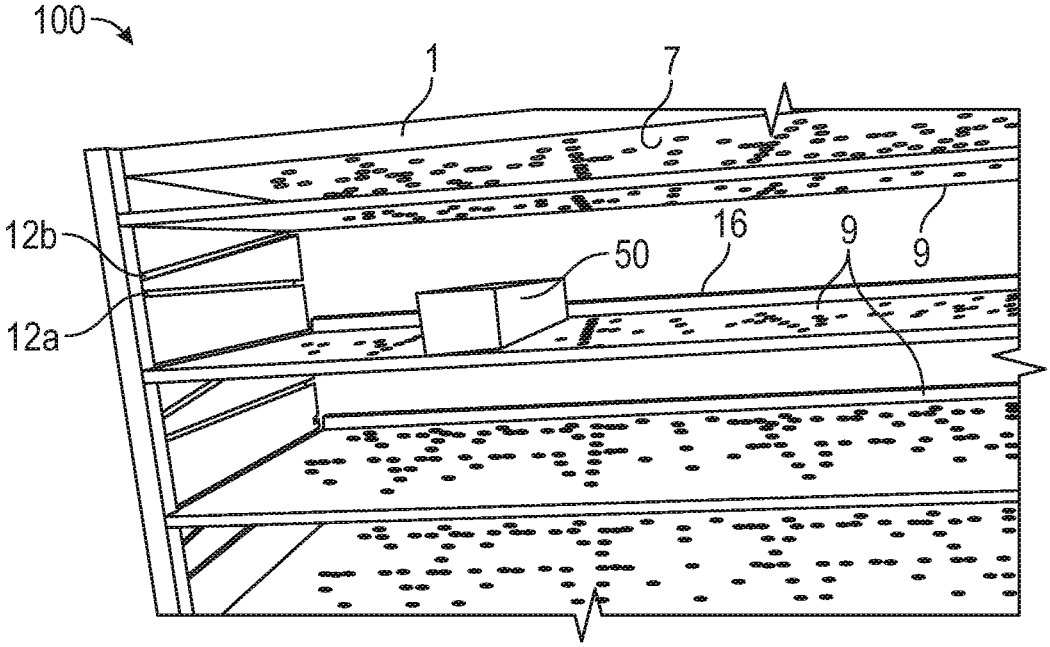
FIG. 9 is a partial front view of boxed product storage on the cabinet of FIG. 8.

FIG. 8 is a perspective view of cabinet 100 having shelves 9 installed in level positions in grooves 12*a*. This shelf position is used for storage of boxes 50 and the like, as shown in FIG. 9.

Figure 10:
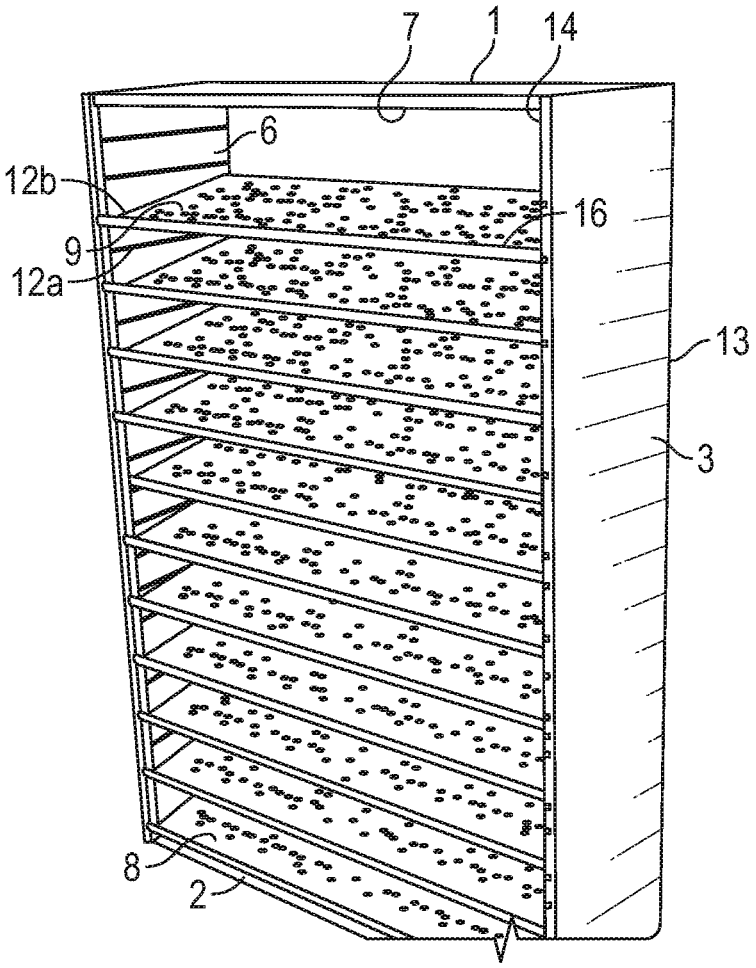
FIG. 10 is a perspective view of a cabinet with slanted shelves according to an embodiment of the present disclosure.
Figure 11:
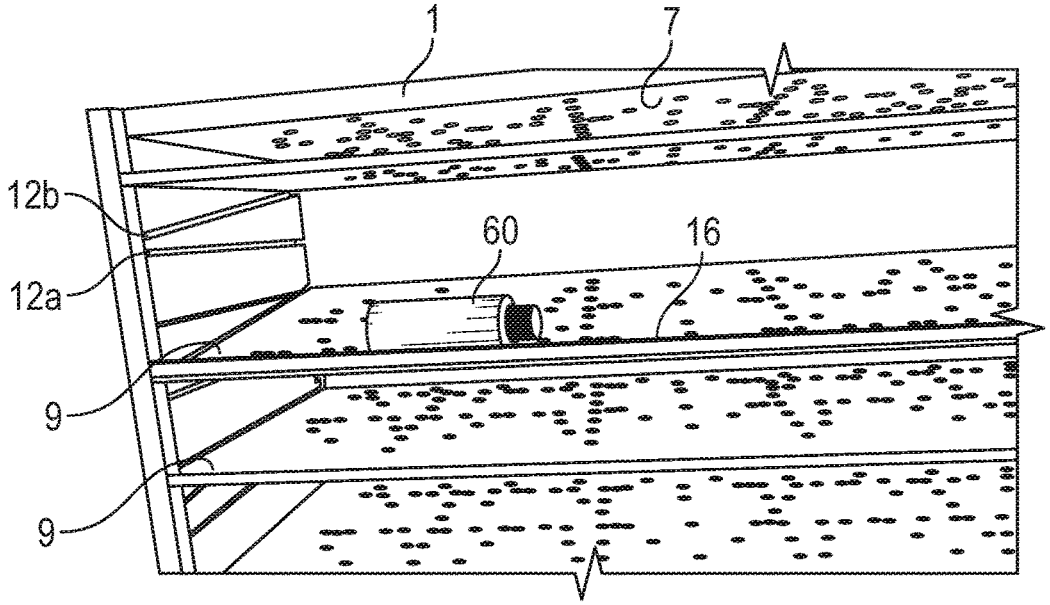
FIG. 11 is a partial front view of tubed product storage on the cabinet of FIG. 10.

FIG. 10 is a perspective view of cabinet 100 having shelves 9 installed in slanted positions in grooves 12*b*. This shelf position is used for storage of open product such as bottles 60 and the like, as shown in FIG. 11. It should be understood that while the figures show all shelves 9 being installed in grooves 12*a* or all shelves 9 being installed in grooves 12*b*, shelves 9 may be installed in a cabinet 100 in a mix of level and slanted orientations without departing from the scope of the disclosure.

FIG. 12 is a view showing attachment of back paneling 11 to cabinet 100.

Figure 13:
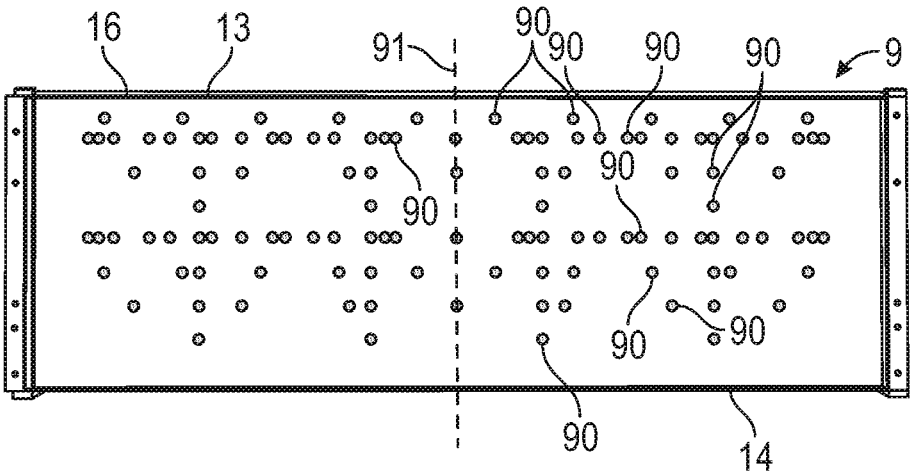
FIG. 13 is a top elevation view of a shelf according to an embodiment of the present disclosure.

As shown in large scale in the various figures, and in close-up in FIG. 13, each shelf 9 includes a plurality of openings 90 therein. The openings 90 are arranged in a pattern that allows the cabinet 100 to be configured with many different partitions that allow the storage of different sizes of product (e.g., 50 and 60). FIGS. 14-18 show specific openings 90 into which dividers 10 are inserted to create a pattern of storage slots in cabinet 100. Dividers 10 in one embodiment are PVC dowels, and may be inserted through top inner pan 7, openings 90 in shelves 9, and bottom inner pan 8 prior to installation of top 1.

Figure 14:
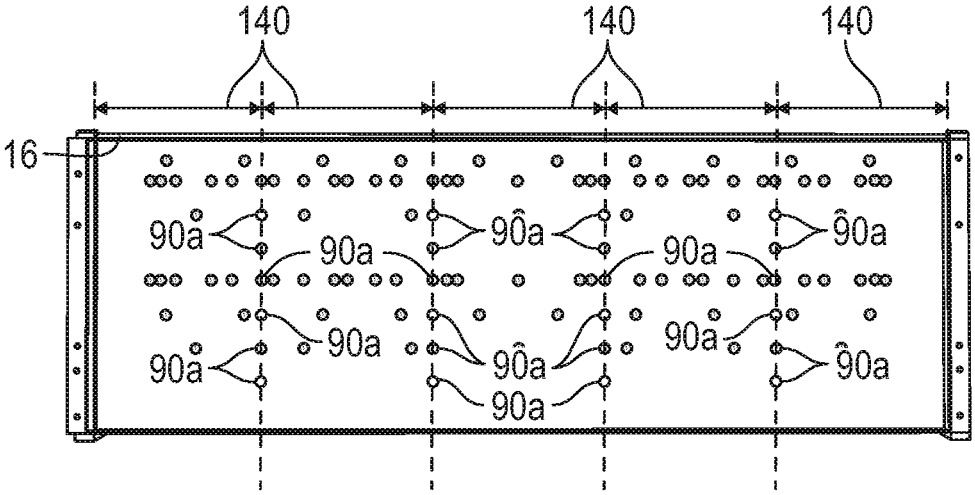
FIG. 14 is a top elevation view of a shelf divider configuration of a first lateral subsection arrangement according to an embodiment of the present disclosure.

FIG. 14 shows specific openings 90*a* through which dividers 10 are inserted to form five (5) lateral storage areas 140 in cabinet 100. Openings 90*a* are shown with white centers in FIG. 14 for clarity.

Figure 15:
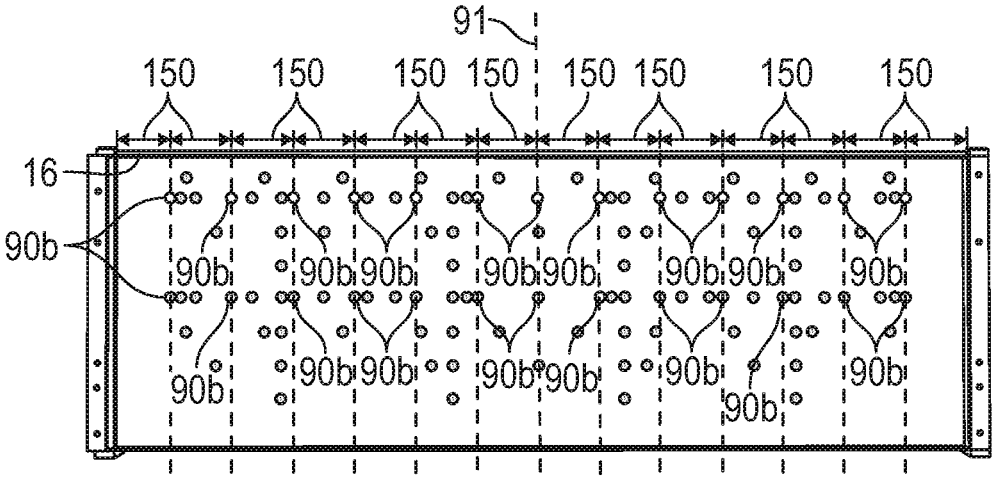
FIG. 15 is a top elevation view of a shelf divider configuration of a second lateral subsection arrangement according to an embodiment of the present disclosure.

FIG. 15 shows specific openings 90*b* through which dividers 10 are inserted to form fourteen (14) lateral storage areas 150 in cabinet 100. Openings 90*b* are shown with white centers in FIG. 15 for clarity.

Figure 16:
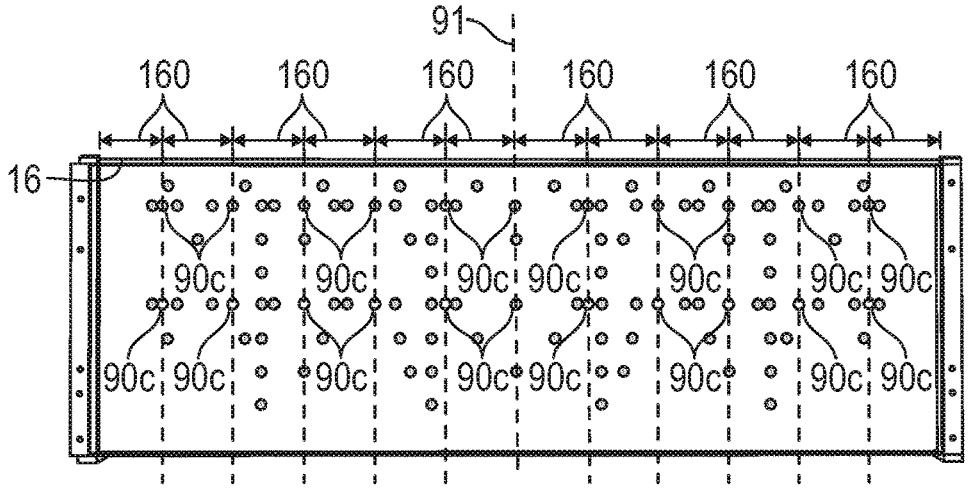
FIG. 16 is a top elevation view of a shelf divider configuration of a third lateral subsection arrangement according to an embodiment of the present disclosure.

FIG. 16 shows specific openings 90*c* through which dividers 10 are inserted to form twelve (12) lateral storage areas 160 in cabinet 100. Openings 90*c* are shown with white centers in FIG. 16 for clarity.

Figure 17:
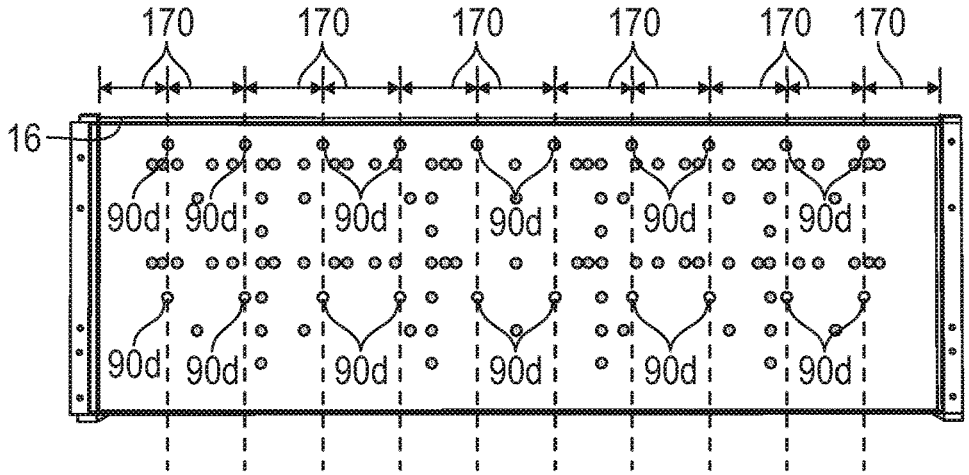
FIG. 17 is a top elevation view of a shelf divider configuration of a fourth lateral subsection arrangement according to an embodiment of the present disclosure.

FIG. 17 shows specific openings 90*d* through which dividers 10 are inserted to form eleven (11) lateral storage areas 170 in cabinet 100. Openings 90*e* are shown with white centers in FIG. 17 for clarity.

Figure 18:
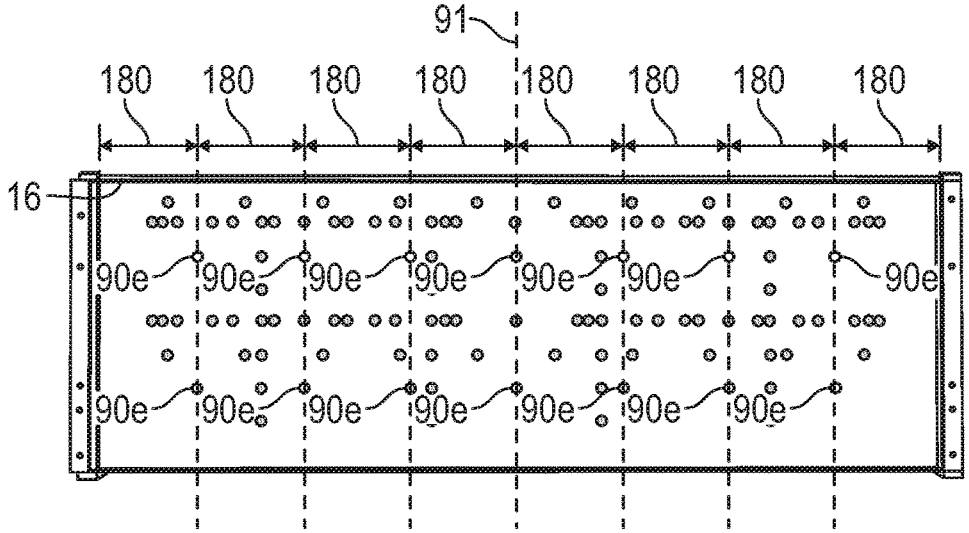
FIG. 18 is a top elevation view of a shelf divider configuration of a fifth lateral subsection arrangement according to an embodiment of the present disclosure.

FIG. 18 shows specific openings 90*e* through which dividers 10 are inserted to form eight (8) lateral storage areas 180 in cabinet 100. Openings 90*e* are shown with white centers in FIG. 18 for clarity.

It should be understood that some configurations (e.g., those of FIGS. 15, 16, and 18) are easily configurable so that one half of the shelf 9 is divided with one configuration, and the other half of the shelf is divided with a different configuration, using the common openings at a lateral center 91 of the shelf 9. Further, combinations of dividers 10 may be inserted along front to back aligned openings 90 to create multiple different product configurations, without departing from the scope of the disclosure.

Figure 19:
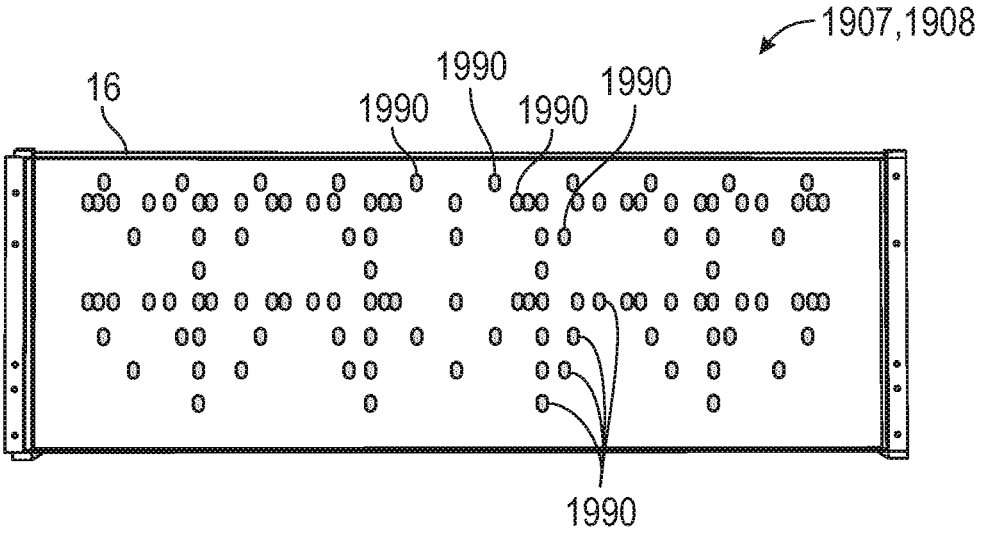
FIG. 19 is a top elevation view of a top or bottom inner pan having elongated openings according to an embodiment of the present disclosure.

In one embodiment, use of shelves 9 in the slanted shelf slots 12*b* will offset the openings 90 through which dividers 10 are inserted to create sections and subsections for product storage and retrieval. In one embodiment, shown in FIG. 19, top and bottom inner pans 1907 and 1908 have openings 1990 that are elongated front 14 to back 13 in place of the round openings 90. This allows for variation in hole 90 placement in shelves 9 that are not the top or bottom inner pan, to accommodate dividers 10 without excess bending thereof. In another embodiment, any shelf 9 that is at an orientation (e.g., slanted) that different from other shelf orientation (e.g., flat) may be provided as shelf 1907, 1908 with elongated openings 1990.

In operation, embodiments of the present disclosure function as follows. All parts Top-Fascia 1, Bottom-Fascia 2, Side-Fascia-Left 3, Side-Fascia-Right 4, Side-Inner-Panel-Left 5, Side-Inner-Panel-Right 6, Top-Inner-Pan 7, Bottom-Inner-Pan 8, Shelve/s 9, Dividers 10 and Back-Panel 11 are cut or designed to a desired dimensions of the end-user. The combination of all parts creates a frame-work of the modular cabinet 100.

The Side-Inner-Panel-Left 5 is adhered into the Side-Fascia-Left 3 and the Side-Inner-Panel-Right 6 is adhered into the Side-Fascia-Right 4 to provide the cabinet with structural integrity and the ability to be fastened (e.g., with screws or the like) to the Top-Fascia 1, Bottom-Fascia 2, Top-Inner-Pan 7 and Bottom-Inner-Pan 8.

The Shelve/s 9 are placed (e.g., by sliding) into the grooves 12*a* or 12*b* of the Side-Inner-Panel-Left 5 and Side-Inner-Panel-Right 6. The grooves 12*a* and 12*b* guide, stabilize, and keep the Shelve/s 9 in proper position within the cabinet 100.

The Dividers 10 that pass through openings (90, 1990) in the Top-Inner-Pan 7, 1907, Shelve/s 9, and Bottom-Pan 8, 1908 create all subsections within the cabinet 100. The Top-Fascia 1 and Bottom-Fascia 2 keep the Dividers 10 within the cabinet 100 itself.

The key-holes in the Top Fascia 1 and the Bottom Fascia 2 allow an end-user to mount cabinet 100 to a wall or other substructure.

Cabinet Assembly

Assembly of the cabinet 100, in one embodiment, is as follows. Side-Inner-Panel-Left 5 and Side-Inner-Panel-Right 6 are structured to fit into left and right side fascia 3 and 4, respectively. Side inner panels 5 and 6 comprise in one embodiment PVC laminated foam, which is routed to create grooves 12*a*, 12*b* for the shelves 9 to slide into. There are grooves 12*a* that run forward 14 to back 13 which are level to the bottom fascia 2 of the cabinet, and therefore to a floor on which the cabinet 100 stands. There are grooves 12*b* that are angled/pitched and which are higher at the back 13 and lower toward the front 14 of the cabinet 100. Shelves 9 may be slid into either of the grooves 12*a*, 12*b*, to provide a customizable product storage and retrieval system of cabinet 100. The slanted grooves 12*b* of Side-Inner-Panel-Left 5 and Side-Inner-Panel-Right 6 mirror each other to allow spherical or tubular products to roll toward the front 14 of the cabinet 100. The level grooves 12*b* of Side-Inner-Panel-Left 5 and Side-Inner-Panel-Right 6 mirror each other to allow boxed or square/rectangular products to be stacked on the shelves 9 of the cabinet 100. Grooves 12*a*, 12*b* may be formed, for example, using a miter-saw or may be routed by an outsourced specialized enterprise. In one embodiment, ungrooved panels 5 and 6 are provided, and grooves such as 12*a*, 12*b* may be formed by an end user to provide a fully customizable shelf arrangement for cabinet 100.

Each Side-Inner-Panel 5, 6, is adhered into its respective Side-Fascia 3, 4, for example with an adhesive. Panels 5 and 6 may be glued in by an end user, provided pre-glued at a manufacturing stage, or outsourced to a specialized enterprise for adhering.

The shelves 9, Top-Inner-Pan 7 and Bottom-Inner-Pan 8 are in one embodiment made out of metal. They each have lips 16 that extend substantially perpendicular to a face of the shelf, and extend laterally from left edge 17 to right edge 18 of each inner pan 7, 8 as it is mounted in the cabinet 100. The lips 16 of inner pans 7 and 8 provide rigidity as well as structure to mount to a wall along with top and bottom fascia 1 and 2. The lips 16 serve a further purpose, by providing a stop when the shelf 9 is mounted in a slanted groove 12*b*, so that product may roll forward to the lip 16 but be stopped from falling off the shelf 9 by the lip 16. If desired, the shelf 9 may be slid into grooves such as grooves 12*a* upside down, so that the lip does not interfere with retrieval of flat or square/rectangle shaped products (e.g., boxed product). As discussed above, the Shelve/s 9, Top-Inner-Pan 7 and Bottom-Inner-Pan 8 have openings 90 in them (which the openings 90 may or may not intersect each other on each individual shelf 9, top-inner-pan 7 and bottom-inner-pan 8). The openings 90 incrementally position divider 10 through the same opening 90 within the top-inner-pan 7, shelves 9 and bottom-inner-pan 8. The shelves 9 in one embodiment have lips at both front and back. This is not only to give the shelves 9 rigidity, but also to keep spherical or tubular products from rolling off a front of the shelf 9.

The Top-Fascia 1 and Bottom-Fascia 2 each have key-holes 15 in them, so that the cabinet 100 may be mounted to a wall or other substrate. The top and bottom fascia 1 and 2 also are fastened to the Side-Fascia 3, 4, and Side-Inner-Panela 5, 6 to create a frame and give strength to the cabinet 100. Bottom fascia 2 may be attached or fastened to the cabinet 100 at this point, or at another point. Top fascia 1 is installed after dividers 10 have been positioned in the cabinet 100.

The Back-paneling 11 is optionally fastened to the combination Side-Fascia 3, 4 and Side-Inner-Panel 5, 6 to increase the sturdiness of the cabinet 100 so it doesn't rock.

In operation, embodiments of the disclosure operate as follows. When a user determines width and height of product to be stored in the cabinet 100, the user configures the shelves and dividers to the width and height of the product/s which will be stored within each subsection. The shelves are slid into the appropriate combination of grooves 12, 12*b* that determine the height of each subsection.

After all the positions of shelves 9 have been determined, and the shelves 9 are placed within the cabinet 100, dividers 10 are installed. To install the dividers 10, they are slid through openings 90, 1900 in the top-pan 7, shelve/s 9, and bottom-pan 8 appropriate to determine the width of each subsection.

The top-fascia 1 is fastened to the cabinet 100 and the cabinet 100 may be mounted to a wall, utilizing the key-holes 15 in the top and bottom fascia 1 and 2.

Products are placed within each subsection in one embodiment by placing used product on top of unopened product or in front of unopened product, depending on the configuration of the cabinet 100.

Product is removed from its subsection when it is desired to be used. This product will become, if not already, the opened product. After use, the opened product may be placed on top of, or in front of, the unopened product remaining in the subsection. This creates a management system where users always use up already opened product completely, before retrieving an unopened product within its subsection.

Embodiments of the present disclosure provide for storage and/or management of any product that needs organizing, and/or displaying. Further, embodiments of the present disclosure provide a customizable organization and/or inventory management system, by dividing and sub-dividing the products within the cabinet 100. Exemplary uses for embodiments of the present disclosure include but are not limited to a management system for artist's supplies; a management system for retail stores, and the like.

The above-disclosed subject matter is to be considered illustrative, and not restrictive, and the appended claims are intended to cover all such modifications, enhancements, and other embodiments, which fall within the true scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A cabinet, comprising:

a frame, comprising a top pan and a bottom pan, and a pair of side panels coupled to the top pan and the bottom pan to form the frame;

a shelf mountable in the frame, the shelf having a plurality of shelf openings therethrough on a shelf face, the shelf openings provided in an irregular pattern to allow multiple lateral subsection configurations with different partition widths for storage of different sizes of product, the irregular pattern comprising a set of unequally spaced openings that allows configuration of partition widths that divide the shelf laterally into a plurality of different sets of equal width openings; and a plurality of straight divider rods sized to be accommodated in the shelf openings, the divider rods configured to span the top pan to the bottom pan of the frame to divide the frame into the multiple lateral subsections.

2. The cabinet of claim 1, wherein each side panel of the pair of side panels comprises a side inner panel and a side outer fascia.

3. The cabinet of claim 2, wherein each side inner panel includes a plurality of slanted grooves and a plurality of level grooves, the plurality of slanted grooves and the plurality of level grooves mirroring each other on opposite sides.

4. The cabinet of claim 2, wherein the side inner panels comprise polyvinyl chloride laminated foam.

5. The cabinet of claim 1, wherein the slanted orientation is toward a front of the frame.

6. The cabinet of claim 1, and further comprising:

a top fascia coupled to and covering a top of the top pan, the top fascia comprising a solid piece; and a bottom fascia coupled to and covering a bottom of the bottom pan, the bottom fascia comprising a solid piece.

7. The cabinet of claim 6, wherein the top fascia and the bottom fascia have key openings for wall mounting the cabinet.

8. The cabinet of claim 1, wherein the shelf has a lip extending laterally from a first side to an opposite second side, the lip extending substantially perpendicular to the shelf face.

9. The cabinet of claim 1, wherein the top pan and the bottom pan each have a matching plurality of pan openings therein, the pan openings matching the irregular pattern of the shelf openings.

10. The cabinet of claim 1, wherein the top pan and the bottom pan each have a matching plurality of pan openings therein, the pan openings matching the irregular pattern of the shelf openings, the plurality of pan openings, the pan openings elongated front to back of the top pan and the bottom pan compared to the plurality of shelf openings.

11. The cabinet of claim 1, and further comprising a back panel coupled to a back of the frame.

12. The cabinet of claim 11, wherein the back panel comprises a plurality of back panel sections.

13. The cabinet of claim 1, wherein the irregular pattern allows for at least six different sets of equal width openings.

14. The cabinet of claim 13, wherein the six different sets of equal width openings include sets of two, five, eight, eleven, twelve, and fourteen equally spaced openings.

15. A method of assembling a cabinet, comprising:

assembling a frame comprising a top pan and a bottom pan, and a pair of side panels coupled to the top pan and the bottom pan;

mounting a shelf in grooves in each of the pair of side panels of the frame, the shelf having a plurality of shelf openings therethrough on a shelf face, the shelf openings provided in an irregular pattern allow multiple lateral subsection configurations with different partition widths for storage of different sizes of product, the irregular pattern comprising a set of unequally spaced openings that allows configuration of partition widths that divide the shelf laterally into a plurality of different sets of equal width openings; and mounting a plurality of straight divider rods into matching shelf openings to span the top pan to the bottom pan of the frame and to divide the frame into the multiple lateral subsections.

16. The method of claim 15, wherein mounting a shelf comprises mounting in one set of a plurality of slanted grooves and a plurality of level grooves mirroring each other on opposite sides of the pair of sides.

17. The method of claim 15, and further comprising:

fastening a top fascia to a top of the top pan, the top fascia comprising a solid piece; and fastening a bottom fascia to a bottom of the bottom pan, the bottom fascia comprising a solid piece.

18. A cabinet, comprising:

a frame, comprising a top pan and a bottom pan, and a pair of side panels coupled to the top pan and the bottom pan to form the frame, the top pan and the bottom pan having a plurality of pan openings therethrough, the pan openings provided in an irregular pattern to provide multiple lateral subsection configurations in the frame with different partition widths for storage of different sizes of product regardless of shelf orientation, the irregular pattern comprising a set of unequally spaced openings that allows configuration of partition widths that divide the shelf laterally into a plurality of different sets of equal width openings;

a shelf adjustably mounted in the frame adjustable to a substantially level orientation or to a slanted orientation, the shelf having a plurality of shelf openings therethrough on a shelf face, the shelf openings matching the irregular pattern of the pan openings, wherein the shelf has a lip extending laterally from a first side to an opposite second side, the lip extending substantially perpendicular to the shelf face;

a plurality of divider rods sized to be accommodated in a same opening of the pan openings and the shelf openings, the divider rods configured to span the top pan to the bottom pan of the frame and to divide the frame into the multiple lateral subsections;

a top fascia coupled to and covering a top of the top pan, the top fascia comprising a solid piece; and a bottom fascia coupled to and covering a bottom of the bottom pan, the bottom fascia comprising a solid piece.

19. The cabinet of claim 18, and further comprising a back panel coupled to a back of the frame.

20. The cabinet of claim 18, wherein the back panel comprises a plurality of back panel sections.

* * * * *